US011939823B2

(12) United States Patent
Murphy

(10) Patent No.: US 11,939,823 B2
(45) **Date of Patent: *Mar. 26, 2024**

(54) ONE-PIECE PRODUCTION/ANNULUS BORE STAB WITH INTEGRAL FLOW PATHS

(71) Applicant: FMC Technologies, Inc., Houston, TX (US)

(72) Inventor: Richard Murphy, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/202,122

(22) Filed: May 25, 2023

(65) Prior Publication Data

US 2023/0304365 A1 Sep. 28, 2023

Related U.S. Application Data

(63) Continuation of application No. 17/931,432, filed on Sep. 12, 2022, now Pat. No. 11,686,164, which is a continuation of application No. 17/644,451, filed on Dec. 15, 2021, now Pat. No. 11,441,365, which is a continuation of application No. 17/506,274, filed on Oct. 20, 2021, now Pat. No. 11,486,207, which is a continuation of application No. 16/906,596, filed on (Continued)

(51) Int. Cl.
*E21B 17/18* (2006.01)
*E21B 33/04* (2006.01)

(52) U.S. Cl.
CPC ..... *E21B 17/18* (2013.01); *E21B 33/04* (2013.01)

(58) Field of Classification Search
CPC ..... E21B 17/18; E21B 33/035; E21B 33/04; E21B 33/043
See application file for complete search history.

(56) References Cited

U.S. PATENT DOCUMENTS 4,109,712 A * 8/1978 Regan ..... E21B 33/0355 251/149.7
4,333,526 A * 6/1982 Watkins ..... E21B 34/02 166/72

(Continued)

FOREIGN PATENT DOCUMENTS

GB 2196410 4/1988
GB 2196410 A * 4/1988 ..... E21B 17/025

OTHER PUBLICATIONS

[No author listed] LEAP Practitioner Request and Verification Form (Petitioner) filed May 5, 2022, 4 pages.

(Continued)

*Primary Examiner* — Matthew R Buck
(74) *Attorney, Agent, or Firm* — Fish & Richardson P.C.

(57) ABSTRACT

One illustrative production/annulus bore stab disclosed herein includes a one-piece body that comprises a first cylindrical outer surface and a second cylindrical outer surface and a plurality of individual fluid flow paths defined entirely within the one-piece body. In this illustrative example, each of the individual fluid flow paths is fluidly isolated from one another and each of the fluid flow paths comprise a first inlet/outlet at a first end of the fluid flow path that is positioned in the first cylindrical outer surface and a second inlet/outlet at a second end of the fluid flow path that is positioned in the second cylindrical outer surface.

30 Claims, 15 Drawing Sheets

Related U.S. Application Data

Jun. 19, 2020, now Pat. No. 11,180,963, which is a continuation of application No. 16/267,960, filed on Feb. 5, 2019, now Pat. No. 10,689,921.

(56) References Cited

U.S. PATENT DOCUMENTS

| | | | | |
|---|---|---|---|---|
| 4,497,369 | A | 2/1985 | Hurta | |
| 4,641,841 | A * | 2/1987 | Regan | E21B 33/038 277/626 |
| 4,695,190 | A | 9/1987 | Best et al. | |
| 4,836,305 | A * | 6/1989 | Curlett | E21B 21/08 175/320 |
| 4,869,318 | A * | 9/1989 | Kellett | E21B 33/04 166/321 |
| 5,217,071 | A * | 6/1993 | Ferry | E21B 17/1035 166/242.3 |
| 5,503,230 | A * | 4/1996 | Osborne | E21B 33/0407 166/344 |
| 5,687,794 | A * | 11/1997 | Watkins | E21B 34/04 166/363 |
| 6,464,261 | B1 * | 10/2002 | Dybevik | E21B 43/08 138/155 |
| 6,488,083 | B2 | 12/2002 | Bartlett | |
| 6,491,097 | B1 * | 12/2002 | Oneal | E21B 17/18 166/278 |
| 6,612,368 | B2 | 9/2003 | Kent | |
| 6,634,427 | B1 * | 10/2003 | Turner | E21B 17/18 166/88.4 |
| 6,666,754 | B1 | 12/2003 | Beckage | |
| 6,675,900 | B2 | 1/2004 | Baskett et al. | |
| 7,063,160 | B2 * | 6/2006 | Fenton | E21B 33/043 166/368 |
| 7,331,396 | B2 | 2/2008 | Reimert | |
| 7,419,001 | B2 * | 9/2008 | Broussard | E21B 33/0422 166/341 |
| 7,604,047 | B2 | 10/2009 | Broussard | |
| 8,286,713 | B2 * | 10/2012 | Broussard | E21B 23/01 166/344 |
| 8,316,946 | B2 | 11/2012 | June | |
| 8,393,354 | B2 | 3/2013 | June | |
| 8,746,347 | B2 * | 6/2014 | Willoughby | E21B 33/043 166/344 |
| 9,279,308 | B2 | 3/2016 | June | |
| 9,702,215 | B1 | 7/2017 | Murphy | |
| 10,145,206 | B2 * | 12/2018 | Williamson | E21B 34/06 |
| 10,316,594 | B2 * | 6/2019 | Shearer | E21B 21/08 |
| 10,393,302 | B2 * | 8/2019 | Dill | F16L 23/12 |
| 10,689,921 | B1 * | 6/2020 | Murphy | E21B 33/04 |
| 11,180,963 | B2 * | 11/2021 | Murphy | E21B 17/18 |
| 11,441,365 | B2 * | 9/2022 | Murphy | E21B 33/04 |
| 11,486,207 | B2 * | 11/2022 | Murphy | E21B 17/18 |
| 11,686,164 | B2 * | 6/2023 | Murphy | E21B 17/18 166/75.11 |
| 2003/0089501 | A1 | 5/2003 | Hartmann | |
| 2006/0260799 | A1 | 11/2006 | Broussard | |
| 2009/0211761 | A1 | 8/2009 | Broussard | |
| 2010/0078176 | A1 | 4/2010 | Christie | |
| 2010/0300700 | A1 | 12/2010 | Garbett | |
| 2014/0060849 | A1 | 3/2014 | Pathak | |
| 2015/0053412 | A1 | 2/2015 | June | |
| 2016/0138355 | A1 * | 5/2016 | Rytlewski | E21B 33/0355 166/336 |
| 2018/0179847 | A1 * | 6/2018 | Derryberry | E21B 33/0355 |
| 2019/0169983 | A1 | 6/2019 | Pollak et al. | |
| 2019/0338620 | A1 | 11/2019 | Burris et al. | |
| 2020/0318442 | A1 | 10/2020 | Murphy | |
| 2022/0034175 | A1 | 2/2022 | Murphy | |
| 2022/0106843 | A1 | 4/2022 | Murphy | |
| 2023/0003088 | A1 | 1/2023 | Murphy | |

OTHER PUBLICATIONS

[No Author Listed], "Petroleum and Natural Gas industries—Design and operation of subsea production systems—Part 1: General requirements and recommendations," British Standard, 2005, 3 pages (PGR2021-00049, Exhibit No. 1037).

[No Author Listed], "The Guide to Deep Hole Drilling, Boring & Honing Costs," Oct. 29, 2021, 11 pages (PGR2021-00049, Exhibit No. 2005).

Corrected Petition for Post Grant Review of U.S. Pat. No. 10,689,921 dated Feb. 22, 2021 (136 pages).

*Dril-Quip, Inc.*, Petitioner, v. *FMC Technologies, Inc.*, Patent Owner, "Declaration of William C. Parks," Case No. PGR2021-00049, U.S. Pat. No. 10,689,921, filed Oct. 29, 2021, 88 pages (Exhibit No. 2002).

*Dril-Quip, Inc.*, Petitioner, v. *FMC Technologies, Inc.*, Patent Owner, "Judgment Final Written Decision," Case No. PGR2021-00049, U.S. Pat. No. 10,689,921, dated Aug. 1, 2022, 88 pages (Paper 32).

*Dril-Quip, Inc.*, Petitioner, v. *FMC Technologies, Inc.*, Patent Owner, "Reply Declaration of William C. Parks," Case No. PGR2021-00049, U.S. Pat. No. 9,945,202, filed Apr. 14, 2020, 59 pages (Exhibit No. 1034).

*Dril-Quip, Inc.*, Petitioner, v. *FMC Technologies, Inc.*, Patent Owner, "Supplemental Declaration of Brian Christie," Case No. PGR2021-00049, U.S. Pat. No. 10,689,921, filed Jan. 28, 2022, 6 pages (Exhibit No. 1032).

*Dril-Quip, Inc.*, Petitioner, v. *FMC Technologies, Inc.*, Patent Owner, "Supplemental Declaration of L. Brun Hilbert, Jr., Ph.D., P.E. in Support of Petition for Post Grant Review of U.S. Pat. No. 10,689,921" Case No. PGR2021-00049, U.S. Pat. No. 10,689,921, filed Jan. 28, 2022, 38 pages (Exhibit No. 1031).

*Dril-Quip, Inc.*, Petitioner, v. *FMC Technologies, Inc.*, Patent Owner, "Patent Owner's Response to Petition," Case No. PGR2021-00049, U.S. Pat. No. 10,689,921, filed on Oct. 29, 2021, 97 pages.

*Dril-Quip, Inc.*, Petitioner, v. *FMC Technologies, Inc.*, Patent Owner, Case No. PGR2021-00049, U.S. Pat. No. 10,689,92, Remote Deposition of Brian Christie, Conducted Oct. 15, 2021, 25 pages (Exhibit No. 2004).

*Dril-Quip, Inc.*, Petitioner, v. *FMC Technologies, Inc.*, Patent Owner, Case No. PGR2021-00049, U.S. Pat. No. 10,689,92, Remote Deposition of L. Brun Hilbert, Jr., Conducted Oct. 13, 2021, 118 pages (Exhibit No. 2003).

*Dril-Quip, Inc.*, Petitioner, v. *FMC Technologies, Inc.*, Patent Owner, Case No. PGR2021-00049, U.S. Pat. No. 10,689,921, Corrected Petitioner's Reply to Patent Owner's Response, Jan. 28, 37 pages.

*Dril-Quip, Inc.*, Petitioner, v. *FMC Technologies, Inc.*, Patent Owner, Case No. PGR2021-00049, U.S. Pat. No. 10,689,921, Remote Deposition of William Parks, Conducted Jan. 12, 2022, 71 pages (Exhibit 1033 in PGR2021-00049).

*Dril-Quip, Inc.*, Petitioners, v. *FMC Technologies, Inc*, Patent Owner, Case No. PGR2021-00049, U.S. Pat. No. 10,689,921 B1, Patent Owner's Objections to Evidence, filed Feb. 4, 2022, 3 pages.

*Dril-Quip, Inc.*, Petitioners, v. *FMC Technologies, Inc*, Patent Owner, Case No. PGR2021-00049, U.S. Pat. No. 10,689,921 B1, Non-Final Office Action dated Mar. 24, 2021 in U.S. Appl. No. 16/906,596, filed May 25, 2021, 5 pages, (Exhibit No. 1030).

*Dril-Quip, Inc.*, Petitioners, v. *FMC Technologies, Inc*, Patent Owner, Case No. PGR2021-00049, U.S. Pat. No. 10,689,921 B1, Patent Owner's Mandatory Notices, filed Mar. 16, 2021, 4 pages.

*Dril-Quip, Inc.*, Petitioners, v. *FMC Technologies, Inc*, Patent Owner, Case No. PGR2021-00049, U.S. Pat. No. 10,689,921 B1, Patent Owner's Notice of Deposition of L. Brun Hilbert, Jr., dated Sep. 29, 2021, 3 pages.

*Dril-Quip, Inc.*, Petitioners, v. *FMC Technologies, Inc*, Patent Owner, Case No. PGR2021-00049, U.S. Pat. No. 10,689,921 B1, Patent Owner's Oral Hearing Demonstratives, filed Aug. 4, 2021, 39 pages.

*Dril-Quip, Inc.*, Petitioners, v. *FMC Technologies, Inc*, Patent Owner, Case No. PGR2021-00049, U.S. Pat. No. 10,689,921 B1, Patent Owner's Sur-Reply, filed Mar. 18, 2022, 32 pages.

*Dril-Quip, Inc.*, Petitioners, v. *FMC Technologies, Inc*, Patent Owner, Case No. PGR2021-00049, U.S. Pat. No. 10,689,921 B1, Petitioner's Demonstrative Exhibits for the Oral Hearing, filed May 5, 2022, 44 pages.

(56) References Cited

OTHER PUBLICATIONS

*Dril-Quip, Inc.*, Petitioners, v. *FMC Technologies, Inc*, Patent Owner, Case No. PGR2021-00049, U.S. Pat. No. 10,689,921 B1, Petitioner's Notice of Deposition of William C. Parks, dated Dec. 21, 2021, 5 pages.
*Dril-Quip, Inc.*, Petitioners, v. *FMC Technologies, Inc*, Patent Owner, Case No. PGR2021-00049, U.S. Pat. No. 10,689,921 B1, Petitioner's Objections to Patent Owner's Evidence Pursuant to 37 CFR 42.64(b)(1), filed Nov. 5, 2021, 4 pages.
*Dril-Quip, Inc.*, Petitioners, v. *FMC Technologies, Inc*, Patent Owner, Case No. PGR2021-00049, U.S. Pat. No. 10,689,921 B1, Petitioner's Updated Mandatory Notices, filed Jan. 25, 2022, 4 pages.
*Dril-Quip, Inc.*, Petitioners, v. *FMC Technologies, Inc*, Patent Owner, Case No. PGR2021-00049, U.S. Pat. No. 10,689,921 B1, Trial Instituted Document, filed Aug. 4, 2021, 53 pages.
*Dril-Quip, Inc.*, Petitioners, v. *FMC Technologies, Inc*, Patent Owner, Case No. PGR2021-00049, U.S. Pat. No. 10,689,921 B1, U.S. Pat. No. 10,316,594, issued on Jun. 11, 2019, filed Feb. 22, 2021, 25 pages, Corrected, (Exhibit No. 1021).
*Dril-Quip, Inc.*, Petitioners, v. *FMC Technologies, Inc*, Patent Owner, Case No. PGR2021-00049, U.S. Pat. No. 10,689,921 B1, U.S. Pat. No. 10,689,92, issued on Jun. 23, 2020, filed Feb. 5, 2021, 20 pages, (Exhibit No. 1001).
*Dril-Quip, Inc.*, Petitioners, v. *FMC Technologies, Inc*, Patent Owner, Case No. PGR2021-00049, U.S. Pat. No. 10,689,921 B1, U.S. Pat. No. 6,675,900, issued on Jan. 13, 2004, filed Feb. 22, 2021, 54 pages, Corrected (Exhibit No. 1024).
*Dril-Quip, Inc.*, Petitioners, v. *FMC Technologies, Inc*, Patent Owner, Case No. PGR2021-00049, U.S. Pat. No. 10,689,921 B1, U.S. Pat. No. 6,675,900, issued on Jan. 13, 2004, filed Feb. 5, 2021, 54 pages, (Exhibit No. 1024).
*Dril-Quip, Inc.*, Petitioners, v. *FMC Technologies, Inc*, Patent Owner, Case No. PGR2021-00049, U.S. Pat. No. 10,689,921 B1, U.S. Pat. No. 7,604,047, issued on Jun. 11, 2019, filed Feb. 5, 2021, 12 pages, (Exhibit No. 1021).
*Dril-Quip, Inc.*, Petitioners, v. *FMC Technologies, Inc*, Patent Owner, Case No. PGR2021-00049, U.S. Pat. No. 10,689,921 B1, U.S. Pat. No. 7,604,047, issued on Oct. 20, 2009, filed Feb. 5, 2021, 20 pages, (Exhibit No. 1020).
*Dril-Quip, Inc.*, Petitioners, v. *FMC Technologies, Inc*, Patent Owner, Case No. PGR2021-00049, U.S. Pat. No. 10,689,921 B1, United States Patent Publication No. 2019/0338620, published on Nov. 7, 2019, filed Feb. 22, 2021, 12 pages, Corrected, (Exhibit No. 1023).
*Dril-Quip, Inc.*, Petitioners, v. *FMC Technologies, Inc*, Patent Owner, Case No. PGR2021-00049, U.S. Pat. No. 10,689,921 B1, United States Patent Publication No. 2019/0338620, published on Nov. 7, 2019, filed Feb. 5, 2021, 12 pages, (Exhibit No. 1023).
*Dril-Quip, Inc.*, Petitioners, v. *FMC Technologies, Inc*, Patent Owner, Case No. PGR2021-00049, U.S. Pat. No. 10,689,921 B1, Scheduling Order, filed Aug. 4, 2021, 13 pages.
*Dril-Quip, Inc.*, Petitioners, v. *FMC Technologies, Inc*, Patent Owner, Case No. PGR2021-00049, U.S. Pat. No. 10,689,921 B1, Setting Oral Argument, filed Apr. 4, 2022, 9 pages.
*Dril-Quip, Inc.*, Petitioners, v. *FMC Technologies, Inc*, Patent Owner, Case No. PGR2021-00049, U.S. Pat. No. 10,689,921 B1, Notice of Joint Stipulation to Modify Due Dates 2-3, filed Jan. 14, 2022, 4 pages.
*Dril-Quip, Inc.*, Petitioners, v. *FMC Technologies, Inc*, Patent Owner, Case No. PGR2021-00049, U.S. Pat. No. 10,689,921 B1, Patent Owner's Notice of Deposition of Brian Christie, dated Sep. 29, 2021, 3 pages.
*Dril-Quip, Inc.*, Petitioners, v. *FMC Technologies, Inc*, Patent Owner, Case No. PGR2021-00049, U.S. Pat. No. 10,689,921 B1, Patent Owner's Request for Oral Argument, filed Mar. 25, 2022, 4 pages.
*Dril-Quip, Inc.*, Petitioners, v. *FMC Technologies, Inc*, Patent Owner, Case No. PGR2021-00049, U.S. Pat. No. 10,689,921 B1, Patent Owner's Updated Exhibit List, filed May 5, 2022, 3 pages.
*Dril-Quip, Inc.*, Petitioners, v. *FMC Technologies, Inc*, Patent Owner, Case No. PGR2021-00049, U.S. Pat. No. 10,689,921 B1, Petitioner's Request for Oral Argument, filed Mar. 25, 2022, 4 pages.
Excerpts from International Standard ISO 13628-1, Petroleum and natural gas industries—Design and Operation of subsea production systems, Part 1: General Requirements and Recommendations, 2d Ed., 2005 (3 pages).
Exhibit No. 1002: File History of U.S. Pat. No. 10,689,921 (229 pages).
Exhibit No. 1003: File History of U.S. Appl. No. 16/906,596 (149 pages).
Exhibit No. 1004: Expert Declaration of L. Brun Hilbert, Jr., Ph.D., P.E. dated Feb. 5, 2021 (172 pages).
Exhibit No. 1005: L. Brun Hilbert, Jr., Ph.D., P.E. Curriculum Vitae, Dril-Quip, Exh. 1005 (7 pages).
Exhibit No. 1006: Declaration of Brian Christie dated Jan. 29, 2021 (14 pages).
Exhibit No. 1007: Appendix to Declaration of Brian Christie (25 pages).
Exhibit No. 1008: Specification for Mudline Suspension/Subsea Wellhead System, Tubing Hanger, Subsea Tree and Nellhead Protection frame Components for Nils Field {"Specification") dated Feb. 1992 (61 pages).
Exhibit No. 1009: General Service Contract 2173 between Dril-Quip {Europe) Lid. and Maersk Olie og Gas A/S dated Jan. 28, 1991 (19 pages).
Exhibit No. 1010: Repair Letter sent from Dril-Quip to Maersk dated Mar. 11, 1993 (1 page).
Exhibit No. 1011: Purchase Order from Maersk Olie og Gas A/S to Dril-Quip {Europe) Lid. dated Jul. 20, 1992 (9 pages).
Exhibit No. 1012: Sales Order from Dril-Quip {Europe) Lid. to Maersk Olie og Gas A/S dated Dec. 1, 1992 (23 pages).
Exhibit No. 1013: Packing Lisi of shipment from Dril-Quip facility in Houston, Texas to Dril-Quip facility in Aberdeen Scotland dated Aug. 20, 1992 (13 pages).
Exhibit No. 1014: CAD drawing of Part No. 2-800004 of Subsea Completion System dated Mar. 18, 1993 (1 page).
Exhibit No. 1015: CAD drawing of Part No. 2-800007 of Subsea Completion System dated Mar. 10, 1993 (1 page.
Exhibit No. 1016: CAD drawing of Part No. 2-899966 of Subsea Completion System last revised Apr. 27, 1993 (1 page).
Exhibit No. 1017: Del norske Veritas {DnV) Design Verification Report dated Apr. 13, 1993 (5 pages).
Exhibit No. 1018: CAD drawing of Part No. 2-899965 of Subsea Completion System last revised Apr. 27, 1993 (1 page).
Exhibit No. 1019: CAD drawing of Part No. 4-SD-60077 of Maersk Regnar Wellhead System (1 page.
Exhibit No. 1022: ANSI/API Specification 17D, dated May 2011 (276 pages).
Exhibit No. 1025: API Recommended Practice 17A, Design and Operation of Subsea Production Systems—General Requirements and Recommendations, Fifth Edition, May 2017 (55 pages).
Exhibit No. 1026: M. Khalifeh and A. Saasen, Introduction to Permanent Plug and Abandonment of Wells, Ocean Engineering & Oceanography, Chapter 2: "General Principles of Well Barriers" (2000) (59 pages).
Exhibit No. 1027: Clegg, W. K., & Orr, K., "Tahoe Subsea Completion—A Successful Application of Existing and New Technologies," OTC 7918 (Jan. 1, 1995). (10 pages).
Exhibit No. 1028: Byers, R. L., Trevitt, R. E., & Philliber, W. R., "Gyrfalcon: World's First 15K Subsea Development," :>TC 11891 (Jan. 1, 2000) (10 pages).
Extended European Search Report in European Appln No. 22205867.1 dated Jan. 23, 2023, 7 pages.
Notice of Accepting Corrected Petition Mailed: Feb. 25, 2021 (2 pages).
Notice of Filing Date Accorded to Petition and Time for Filing Patent Owner Preliminary Response Mailed: Feb. 19, 2021 (6 pages).
PCT International Search Report and Written Opinion in Appln. No. PCT/US2020/015190, dated Apr. 23, 2020, 2020, 13 pages.

(56) References Cited

OTHER PUBLICATIONS

PCT Search Report and Written Opinion from corresponding applications PCT/US2020/015190, dated Apr. 23, 2020.
Petition for Post Grant Review of U.S. Pat. No. 10,689,921 dated Feb. 5, 2021 (135 pages).
Petition for Post Grant Review of U.S. Pat. No. 10,689,921 Patent Owner's Preliminary Response dated May 19, 2021 (66 pages).
Petition for Post Grant Review of U.S. Pat. No. 10,689,921 Patent Owner's Power of Attorney dated Mar. 16, 2021 (1 page).
Petition for Post Grant Review of U.S. Pat. No. 10,689,921 Power of Attorney dated Jan. 27, 2021 (3 pages).
Sadd, "Elasticity: Theory, Applications, and Numerics," Academic Press, 2004, 2 pages (PGR2021-00049, Exhibit No. 1035).
Timoshenko et al., "Theory of Elasticity," McGraw-hill Book Company, Inc., 1951, 4 pages (PGR2021-00049, Exhibit No. 1036.
U.S. Publication No. 2019/0169983, published Jun. 6, 2019, Pollak et al., (PGR2021-00049, Exhibit 2006), 11 pages.
USPTO Patent Trial and Appeal Board, "Decision on Granting Institution of Post-Grant Review," PGR No. 2021-00049, U.S. Pat. No. 10,689,921, dated Aug. 4, 2021, 53 pages.
Xhibit No. 1029: Zhang, B., Guan, Z., Hasan, A.R., Lu, N., Wang, Q., Xu, Y., Zhang, Q., and Liu, Y. (2020)Development and design of new casing to mitigate trapped annular pressure caused by thermal expansion in oil and Jas wells. Applied Thermal Engineering, vol. 118, May 25, 2017 (7 pages).

* cited by examiner

ONE-PIECE PRODUCTION/ANNULUS BORE STAB WITH INTEGRAL FLOW PATHS

This application is a continuation of and claims the benefit of priority to U.S. patent application Ser. No. 17/931,432, filed Sep. 12, 2022, which is a continuation of and claims the benefit of priority to U.S. patent application Ser. No. 17/644,451, filed Dec. 15, 2021, now issued as U.S. Pat. No. 11,441,365 on Sep. 13, 2022, which is a continuation of U.S. patent application Ser. No. 17/506,274, filed Oct. 20, 2021, now issued as U.S. Pat. No. 11,486,207 on Nov. 1, 2022, which is a continuation of U.S. patent application Ser. No. 16/906,596, now issued as U.S. Pat. No. 11,180,963 on Nov. 23, 2021, which is a continuation of U.S. patent application Ser. No. 16/267,960, now issued as U.S. Pat. No. 10,689,921 on Jun. 23, 2020, the contents of which are incorporated by reference herein.

TECHNICAL FIELD

The present disclosed subject matter generally relates to various embodiments of a one-piece production/annulus bore stab with integral flow paths.

BACKGROUND

A typical wellhead structure for an oil and gas well includes a high-pressure wellhead housing secured to a low-pressure housing, such as a conductor casing. The wellhead structure supports various casing strings that extend into the well. One or more casing hangers are typically landed in the high-pressure wellhead housing, with each casing hanger being located at the upper end of a string of casing that extends into the well. A tubing hanger is also typically landed in the wellhead or a tubing head. A string of production tubing is supported by the tubing hanger. The production tubing extends through the production casing and provides a path for conveying production fluids from the formation to the wellhead. The area between the production tubing and the production casing is referred to as the annulus.

An oil/gas well also typically includes a production tree (also referred to as a Christmas tree) that is mounted on the high-pressure housing. The production tree includes a main production bore. Production bore stabs are commonly positioned between the main production bore of a production tree and the production bore of the tubing hanger so as to provide a flow passageway between those two production bores. This arrangement permits the production bore of the production tree and the production bore of the tubing hanger to be fluidly isolated from other bores and passageways within the completion system.

FIGS. 1-4 depict various aspects of one illustrative example of a prior art two-piece production/annulus bore stab 10. FIG. 2 is a cross-sectional view of the prior art production/annulus bore stab 10 taken through the axial length of the production/annulus bore stab 10. FIGS. 3 and 4 are transverse cross-sectional views of the production/annulus bore stab 10 taken where indicated in FIG. 1. As shown in these drawings, the prior art production/annulus bore stab 10 generally comprises an inner production stab body 11, an outer annulus stab body 12, an annulus T-ring 13, an annulus metal seal 14 and an annulus seal retainer 15. The production/annulus bore stab 10 also comprises a secondary annulus spacer 16, a secondary metal seal 17, a spacer 18, a primary metal seal 19 and a primary seal retainer 20. Also depicted is a set screw 21, a lower head cap screw 22, a set screw 23, a plurality of upper flow openings 24, a plurality of lower flow openings 25 and a plurality of flow channels 26. In general, the set screw 21 secures the annulus seal retainer 15 in position with respect to the outer annulus stab body 12 so as to secure the secondary metal seal 17 in position. The primary seal retainer 20 is adapted to be threadingly coupled to the inner production stab body 11 to retain the primary metal seal 19 in position and thereby provide a seal between an end 12A of the outer annulus stab body 12 and the outer surface 11A of the inner production stab body 11.

As shown in FIGS. 3 and 4, the outer surface 11A of the inner production stab body 11 has a plurality of channels or recesses 26 formed therein. When the inner production stab body 11 is positioned within the outer annulus body 12, a plurality of individual fluid flow paths 27 are defined between the recesses 26 and the inner surface 12B of the outer annulus stab body 12. Each of these fluid flow paths 27 is in fluid communication with one of the upper openings 24 and one of the lower openings 25.

The present application is directed to various embodiments of an improved one-piece production bore stab with integral flow paths.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

The present application is generally directed to various embodiments of a one-piece production/annulus bore stab with integral flow paths. One illustrative production/annulus bore stab disclosed herein comprises a one-piece body that comprises a first cylindrical outer surface and a second cylindrical outer surface and a plurality of individual fluid flow paths defined entirely within the one-piece body. In this illustrative example, each of the individual fluid flow paths is fluidly isolated from one another with the body and each of the fluid flow paths comprise a first inlet/outlet at a first end of the fluid flow path that is positioned in the first cylindrical outer surface and a second inlet/outlet at a second end of the fluid flow path that is positioned in the second cylindrical outer surface.

BRIEF DESCRIPTION OF THE DRAWINGS

Certain aspects of the presently disclosed subject matter will be described with reference to the accompanying drawings, which are representative and schematic in nature and are not be considered to be limiting in any respect as it relates to the scope of the subject matter disclosed herein.

Figure 1:
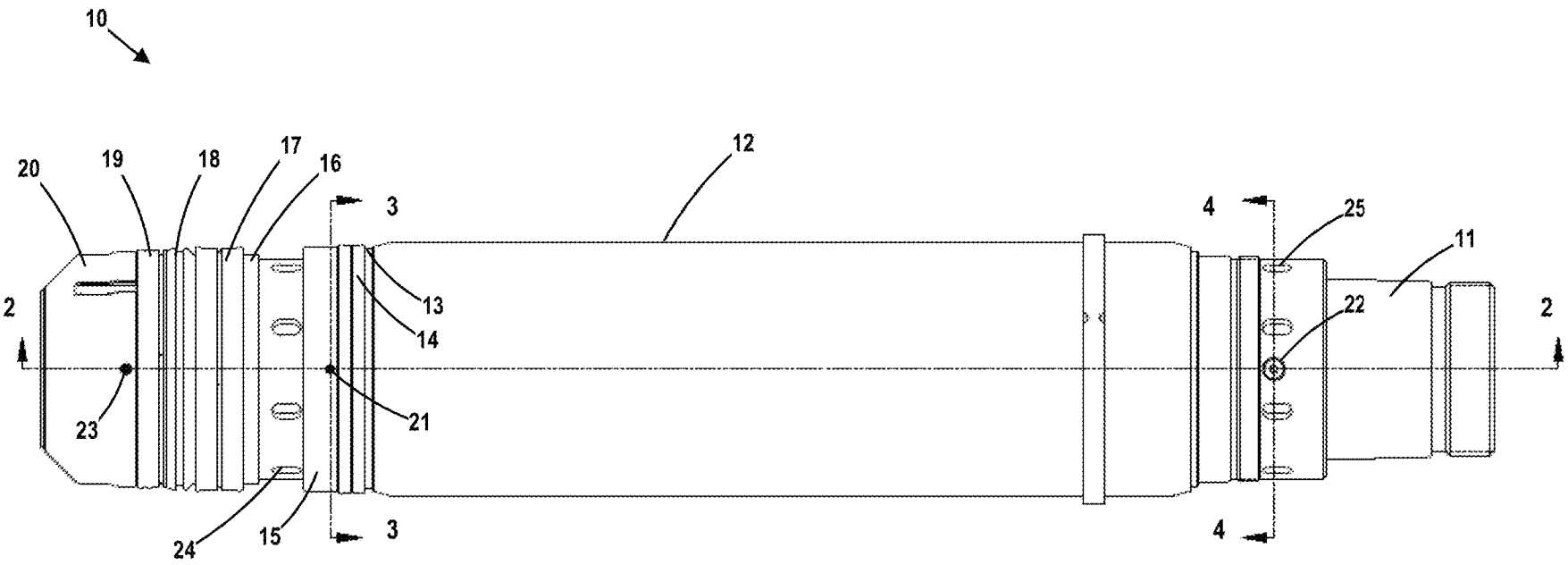
Fig. 1 (Prior Art)
FIGS. 1-4 depict various aspects of a prior art production/annulus bore stab.
Figure 2:
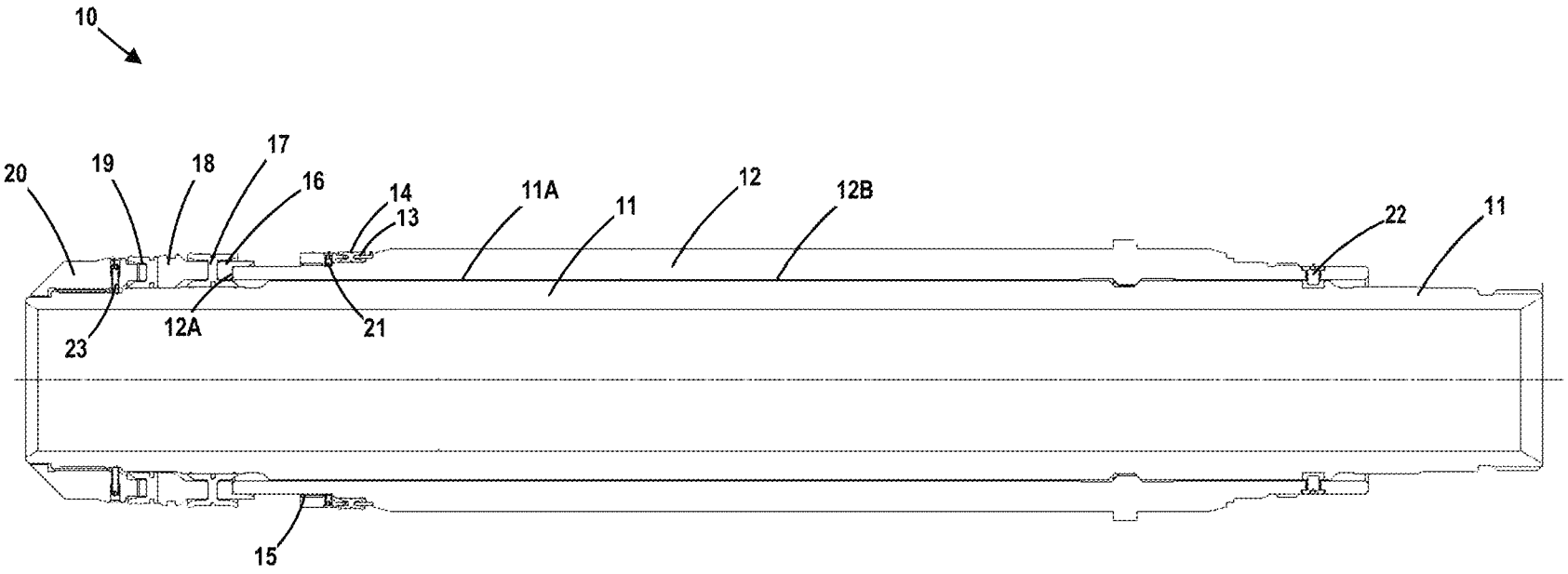
Fig. 2 (Prior Art)
Figure 4:
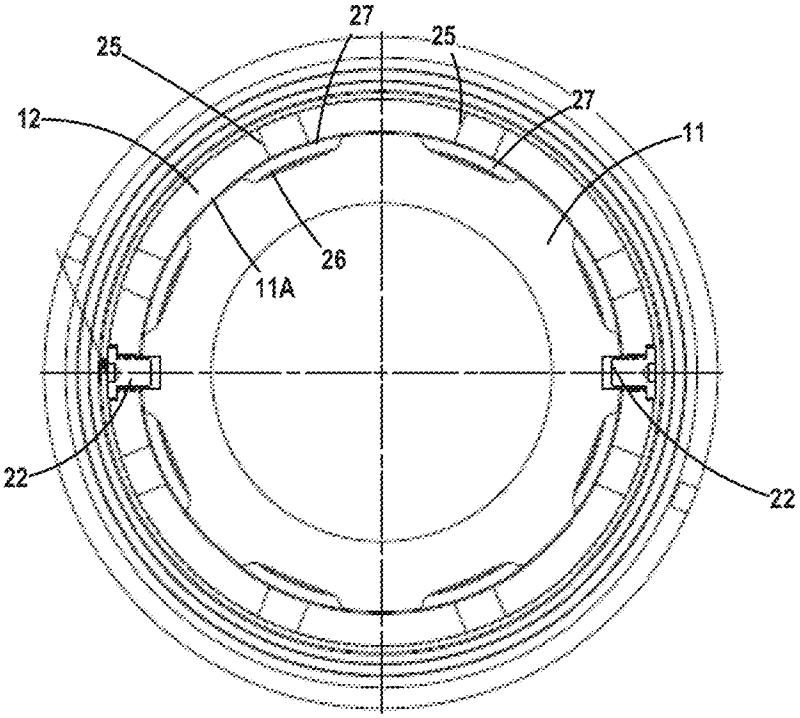
Fig. 4 (Prior Art)
Figure 3:
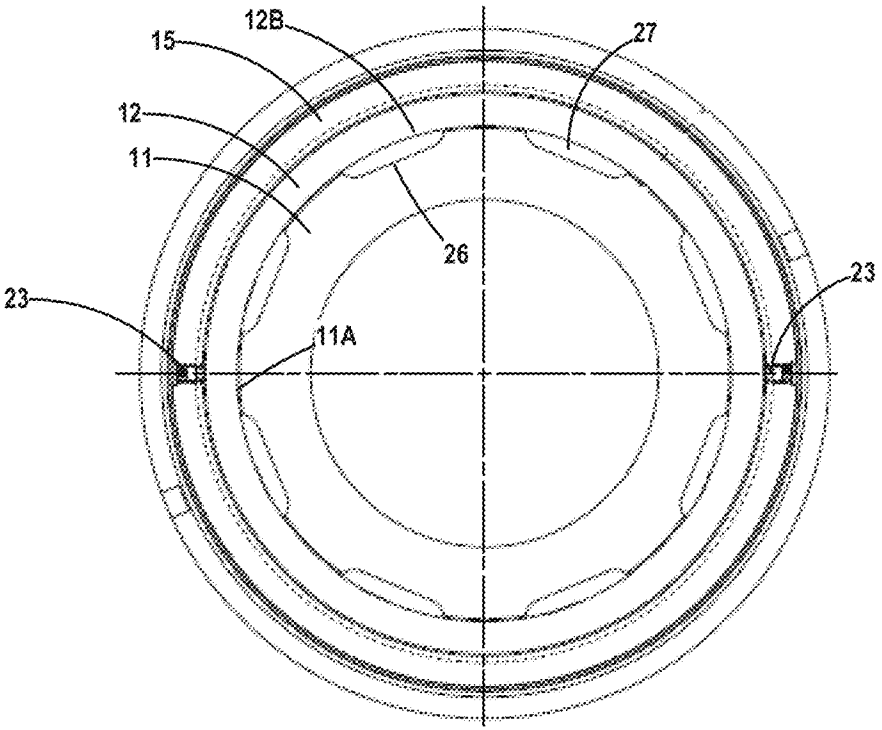
Fig. 3 (Prior Art)

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 5:
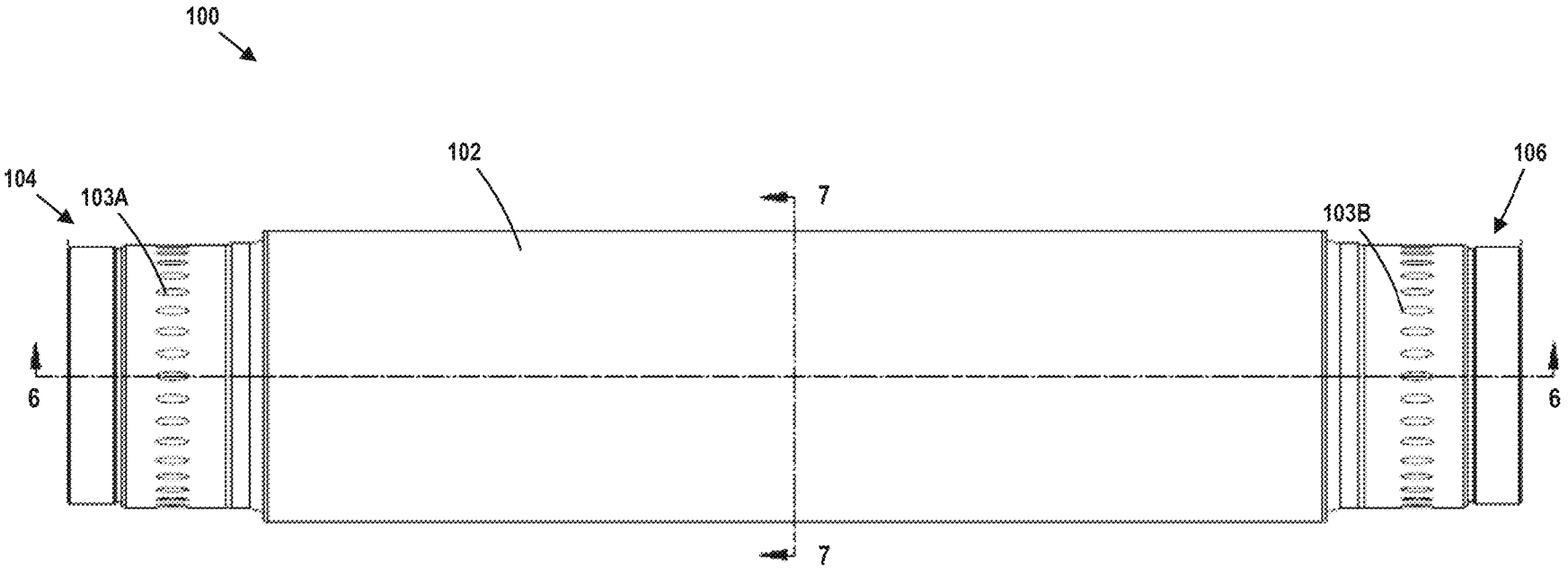
FIGS. 5-12 depict various aspects of various embodiments of a one-piece production/annulus bore stab with integral flow paths.
Figure 6:
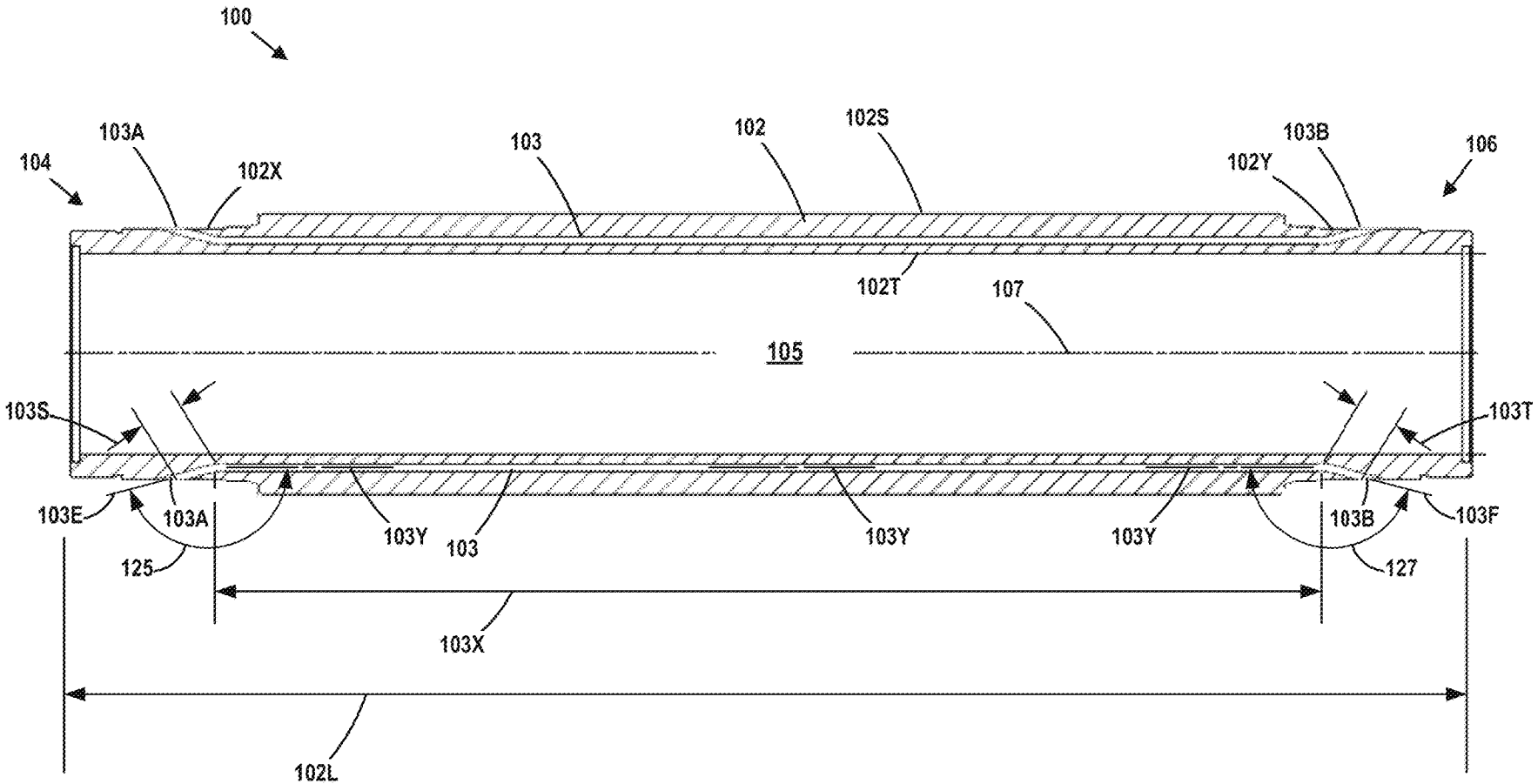
Figure 7:
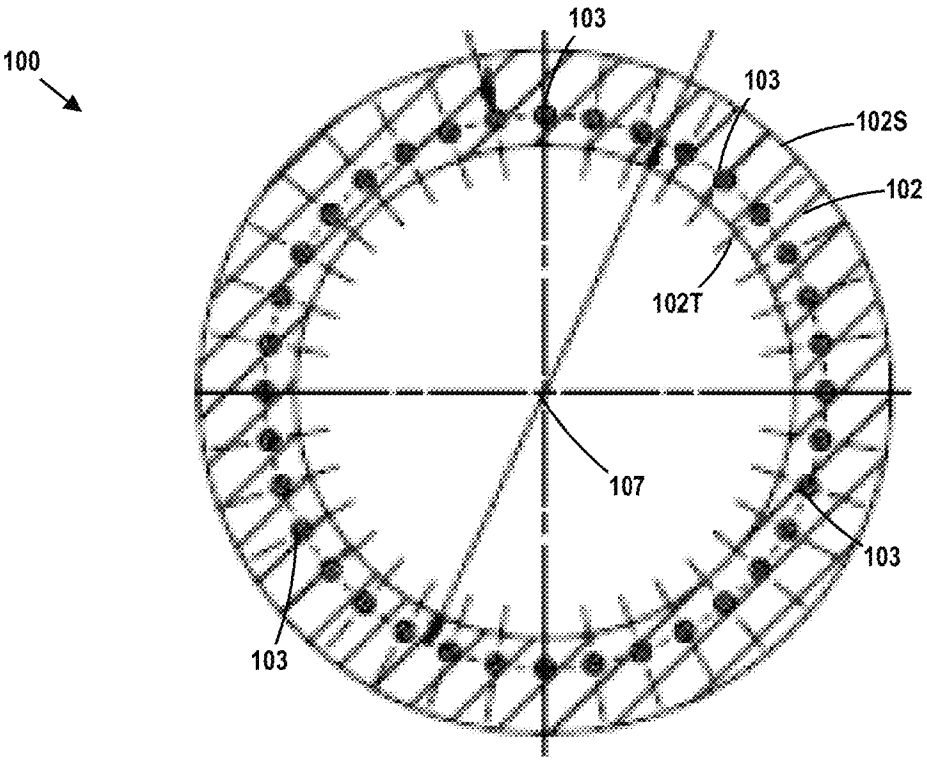
Figure 8:
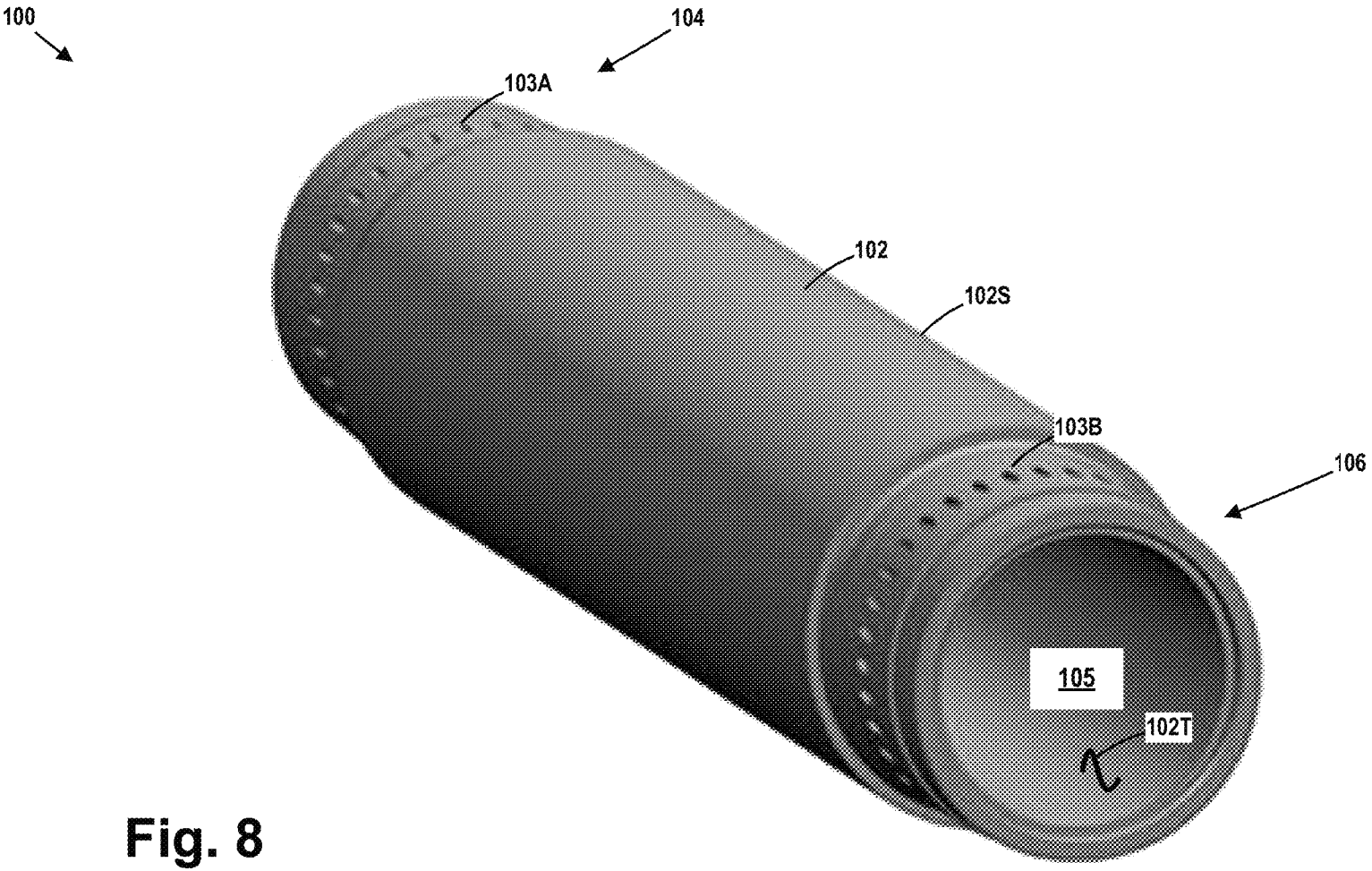
Figure 9:
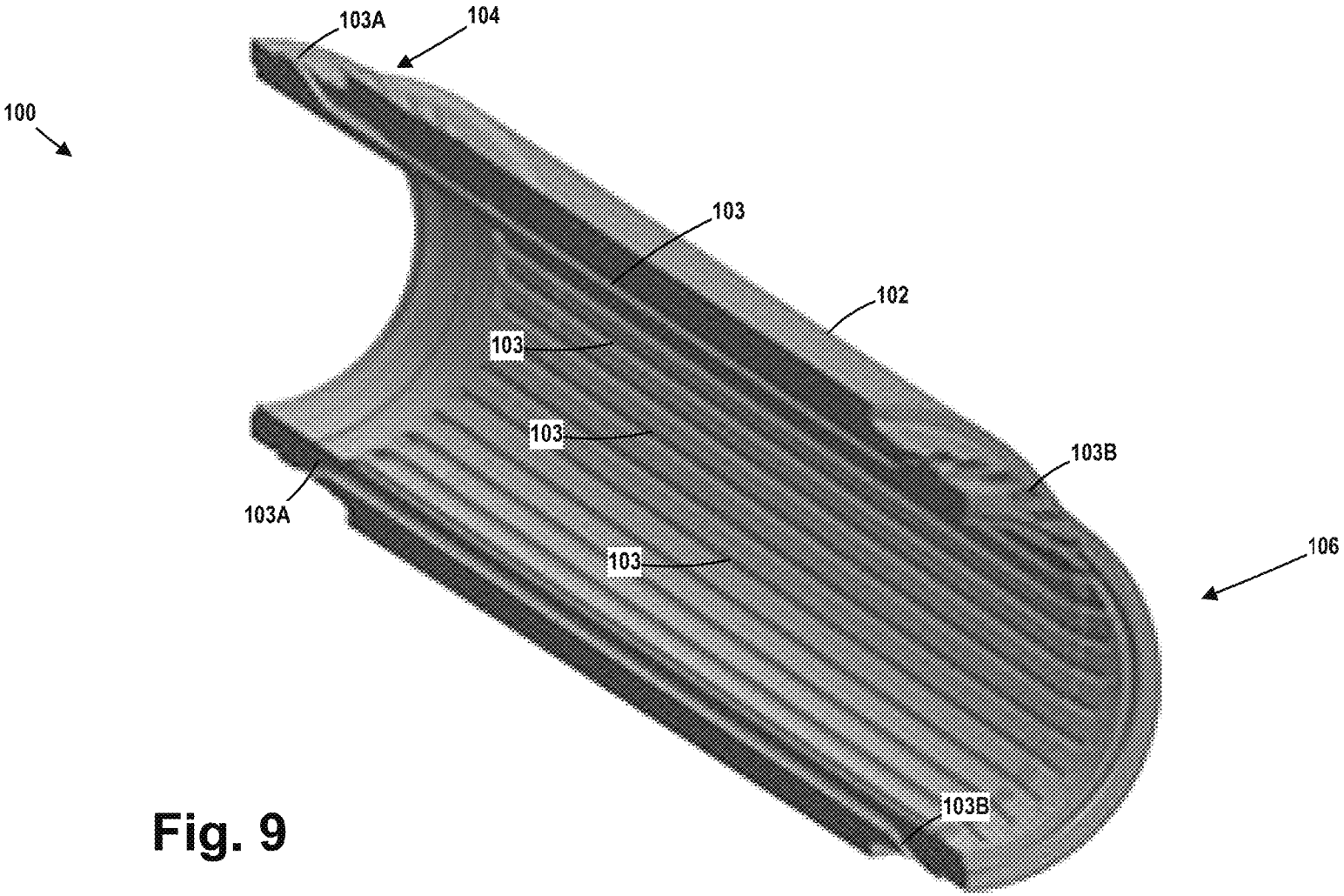

FIGS. 5-12 depict various aspects of various embodiments of a one-piece production/annulus bore stab 100 with integral flow paths. FIG. 5 is a side view of one illustrative embodiment of a one-piece production/annulus bore stab 100 disclosed herein. FIG. 6 is a cross-sectional view of the illustrative one-piece production/annulus bore stab 100 taken through the axial length of the production/annulus bore stab 100. FIG. 7 is a transverse cross-sectional view of the production/annulus bore stab 100 taken where indicated in FIG. 5. FIG. 8 is a perspective view of the depicted example of a one-piece production/annulus bore stab 100. FIG. 9 is a cross-sectional perspective view of the one-piece production/annulus bore stab 100 taken through the axial length of the production bore stab 100.

In general, one illustrative embodiment of a novel production/annulus bore stab 100 disclosed herein comprises a unitary, one-piece body 102 with a first end 104 and a second end 106. The body 102 has an outermost cylindrical surface 102S and an inner cylindrical surface 102T. Also depicted in FIG. 6 are a central bore 105 and an axial centerline 107 of the one-piece production/annulus bore stab 100. The physical dimensions of the one-piece body 102, e.g., the axial length 102L, outside diameters, the inside diameter of the one-piece production/annulus bore stab 100, as well as the radial thickness of the body 102 at various locations along the axial length 102L, may vary depending upon the particular application.

A plurality of individual and separate flow paths 103 are formed within the body 102. Each of the flow paths 103 has a first inlet/outlet 103A positioned at a first end (adjacent end 104) of the flow path 103 and a second inlet/outlet 103B that is positioned at a second end (adjacent end 106) of the fluid flow path 103. The first inlet/outlets 103A are positioned in or extend through a first cylindrical outer surface 102X of the one-piece body 102, while the second inlet/outlets 103B are positioned in or extend through a second cylindrical outer surface 102Y of the one-piece body 102. The outside diameters of the first and second cylindrical outer surfaces 102X, 102Y, respectively, may be the same or they may be different from one another. As indicated, in one illustrative example, each of the plurality of individual fluid flow paths 103 are formed or defined entirely within the one-piece body 102. Moreover, in one illustrative embodiment, each of the individual fluid flow paths 103 are fluidly isolated from one another within the one-piece body 102. As depicted, in one illustrative embodiment, each of the plurality of individual flow paths 103 extends for substantially the entire axial length 102L of the one-piece body 102.

The routing and configuration of the individual flow paths 103 within the one-piece body 102 may vary depending upon the particular application. In one particularly illustrative example, each of the plurality of individual flow paths 103 may comprise an axial length portion 103X having a centerline 103Y that is substantially parallel to the longitudinal centerline 107. In other applications, all or part of the one or more of the flow paths 103 may be oriented in a non-parallel relationship with respect to the longitudinal centerline 107. For example, at least portions of the flow paths 103 may be curved or otherwise non-linear with respect to the centerline 107 (or some other reference). Thus, the configuration or positioning of portions of the flow paths 103 with respect to the longitudinal centerline 107 (or some other reference) may vary depending upon the particular application.

With continuing reference to FIG. 6, in this particular example, each of the fluid flow paths 103 comprises a first flow path transition region 103S between the axial length portion 103X and the first inlet/outlet 103A, and a second flow path transition region 103T between the axial length portion 103X and the second inlet/outlet 103B. As also depicted, a line 103E extending through a center of the first inlet/outlet 103A and intersecting the flow path centerline 103Y at a first end of the axial length portion 103X defines a first included angle 125 that is an obtuse angle. Similarly, a line 103F extending through a center of the second inlet/outlet 103B and intersecting the flow path centerline 103Y at a second end of the axial length portion 103X defines a second included angle 127 that is an obtuse angle. In some applications, the angles 125, 127 may be approximately the same. In other applications, the angles 125, 127 may be different from one another. Additionally, the size, i.e., diameter of the flow paths 103 as well as the number of flow paths 103 may vary depending upon the particular application. With reference to FIG. 7, the illustrative one-piece production/annulus bore stab 100 disclosed herein comprises thirty-six flow paths 103, each of which have a diameter of approximately 6.35 mm (0.25 inches).

Figure 10:
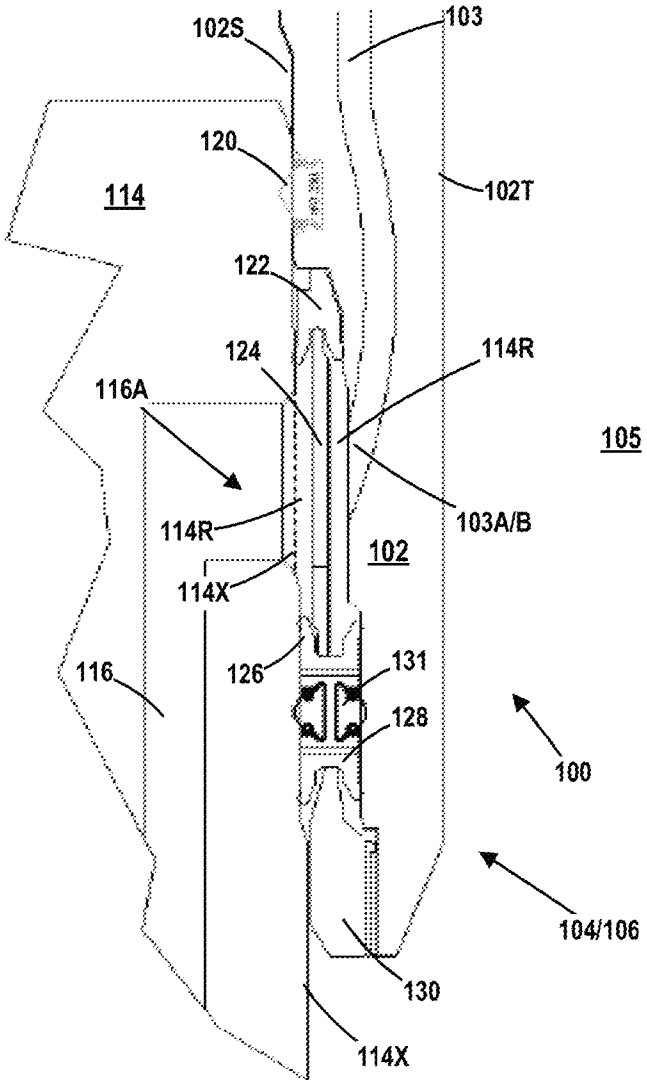

FIG. 10 is a cross-sectional view depicting the engagement and positioning of one end of the one-piece production/annulus bore stab 100 relative to another item of equipment 114, e.g., a tubing hanger or the valve block of a production tree. Also depicted in FIG. 10 is an elastomer seal 120, a seal 122, a seal spacer 124, a seal 126, a seal 128, an elastomer seal 131 and a seal retaining ring 130 that is threadingly coupled to the body 102. All of the illustrative seals and spacers depicted in FIG. 10 may or may not be present in all applications. The equipment 114 comprises at least one annulus fluid flow passageway or path 116 (only one of the annulus fluid flow passageways 116 is shown in FIG. 10). In one illustrative example, each of the one or more annulus fluid flow paths 116 is adapted to be in fluid communication with a radial gallery (or annulus fluid collection chamber) 116A. In some applications, the equipment 114 may contain a plurality of such collection chambers 116A, each of which may be fluidly isolated from one another. In one illustrative example, the annulus fluid collection chamber 116A may be defined (in whole or part) by the outer diameter (102X or 102Y) of the body 102 and the inner diameter 114X of the equipment 114.

In one illustrative example, the annulus fluid collection chamber 116A is adapted to be placed in fluid communication with one or more (and sometimes all) of the annulus fluid flow paths 103 in the body 102. The seal spacer 124 may comprise one or more openings that allow fluid to flow freely between the flow paths 103/the annulus fluid collection chamber 116A and the one or more flow paths 116 in the equipment 114. The illustrative embodiment of the one-piece production/annulus bore stab 100 discussed above may be manufactured using a variety of known manufacturing techniques, e.g., hot isostatic pressing (HIP), 3D printing, etc.

Figure 11:
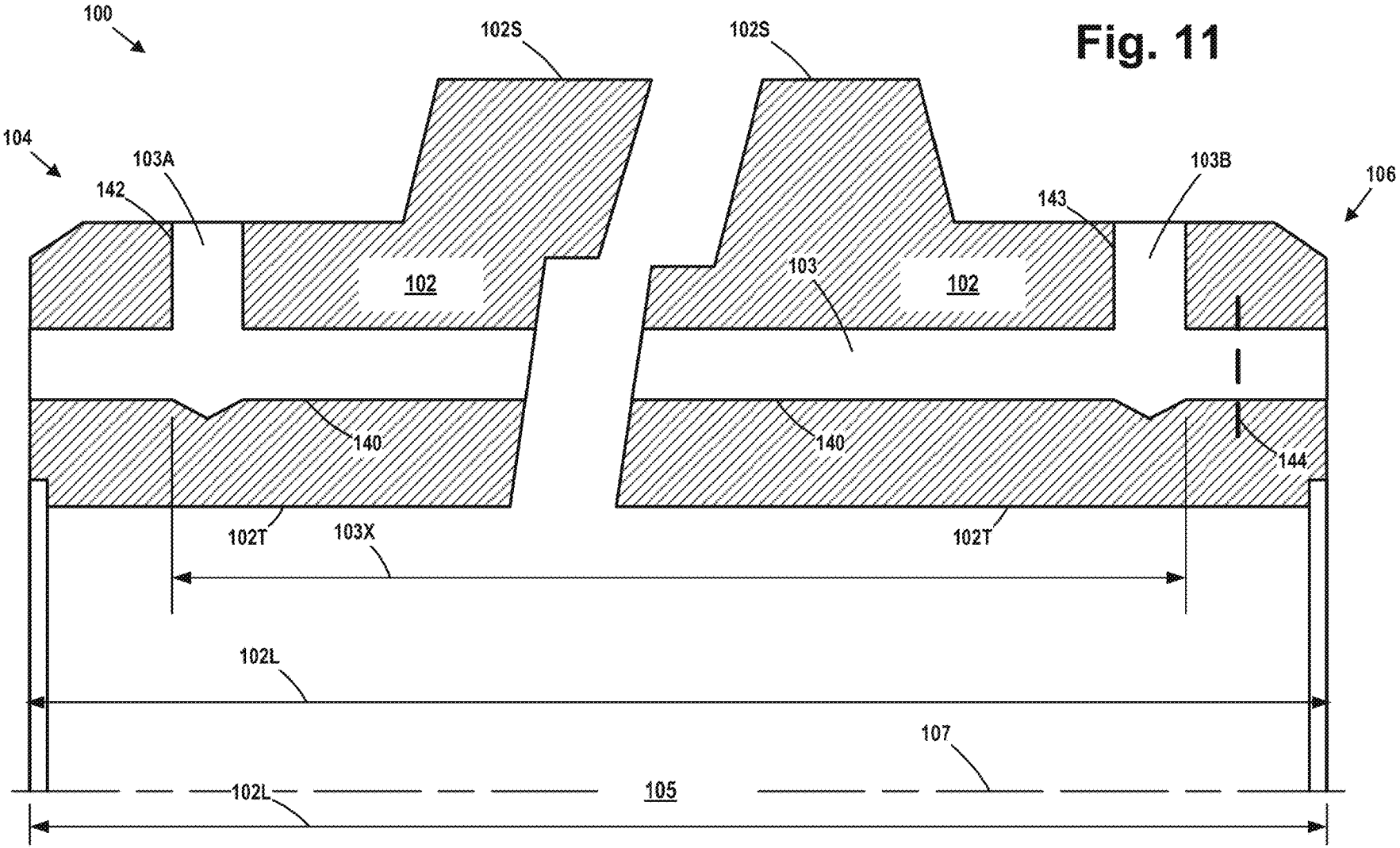
Figure 12:
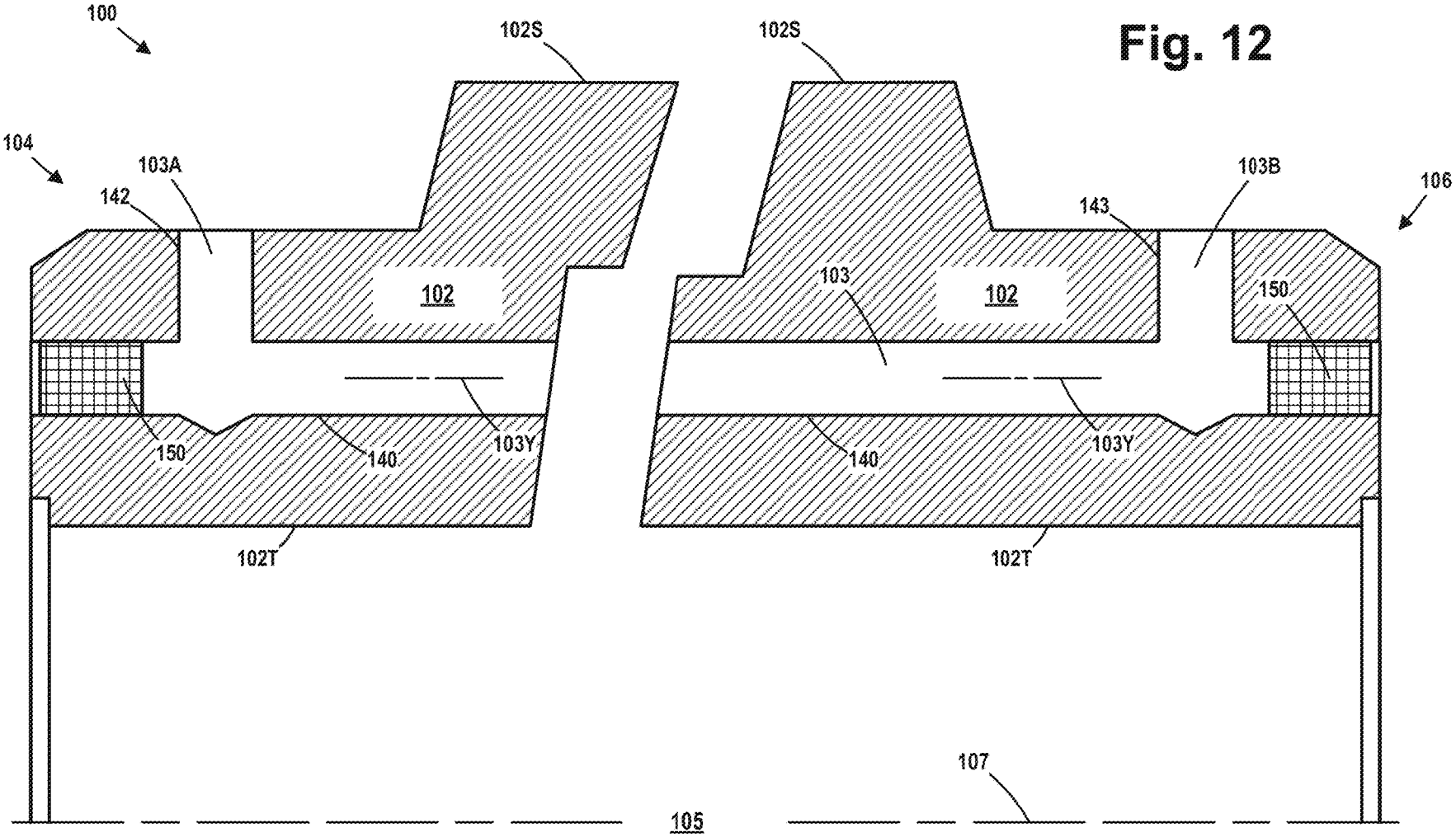

FIGS. 11 and 12 depict an embodiment of the one-piece production/annulus bore stab 100 wherein the individual flow paths 103 in the body 102 are formed by a process that includes drilling a plurality of intersecting bores in the body 102. FIG. 11 depicts the one-piece production/annulus bore stab 100 at a point where a plurality of axial bores 140 (only one of which is shown) have been drilled though the entire axial length 102L of the body 102 to define at least part of the axial length portion 103X of one of the flow paths 103 with a centerline 103Y. In some applications, the axial bores 140 need not extend throughout the entire axial length 102L of the body 102, e.g., the bores 140 may stop within the body at, for example, a location within the body 102 indicated by the dashed line 144 adjacent the end 106. In some applications, the axial bores 140 may be drilled in a single pass, e.g., from the end 104 through the end 106. In other applications, the axial length 102L of the one-piece production bore stab 100 may be such that each of the axial bores 140 is formed by drilling a bore from each of the opposite ends 104, 106 into the body 102 to form one of the flow paths 103, wherein these separate bores are substantially co-linear with one another (or otherwise in fluid communication with one another) and at least partially engage one another within the body 102.

Also depicted in FIG. 11 are first and second radial bores 142, 143 that are drilled to intersect with one of the axial bores 140. As indicated, in one illustrative example, the radial bores 142 and 143, respectively, correspond to the first and second inlet/outlet 103A, 103B of each of the fluid flow paths 103. In the depicted example, the axial bores 140 were formed prior to the formation of the radial bores 142, 143, but the order could be reversed if desired. FIG. 12 depicts the one-piece production bore stab 100 after plugs 150 were secured within the axial openings 140 at opposite ends thereof. The plugs 150 may be secured in position using any of a variety of known techniques, e.g., welding, providing a threaded connection between the plugs 150 and the axial bore 140, etc. Of course, in the example where the axial bores 140 do not extend throughout the entire axial length of the body 102, e.g., the case where they stop at location 144 (see FIG. 11), then only a single plug 150 would be required within each of the axial bores 140. With the plug(s) 150 installed, a plurality of individual flow paths 103 have been formed within the one-piece body 102. More specifically, in this example, each of the plurality of individual flow paths 103 (formed entirely within the body 102) comprises first and second radially-oriented flow paths 142, 143 that are in fluid communication with one of the axial bores 140, wherein the first radially-oriented flow path 142 terminates at the first inlet/outlet 103A and the second radially-oriented flow path 143 terminates at the second inlet/outlet 103B. In this particular example, a centerline of each of the first and second radially-oriented openings 142, 143 is positioned substantially normal to the flow path centerline 103Y of the axial bore 140. In the example shown in FIGS. 11 and 12, the bores 140, 142, 143 were formed by drilling the bores into the body 102. In other applications, such bores may be formed by other manufacturing processes, e.g., laser boring, etc.

As will be appreciated by those skilled in the art after a complete reading of the present application, one illustrative example of a novel one-piece production/annulus bore stab 100 with integral fluid flow paths 103 formed entirely within the one-piece body 102 disclosed herein provides some distinct advantages relative to prior art production bore stabs and annulus bore stabs. One problem associated with the illustrative prior art production/annulus stab body 10 discussed in the background section of this application involved maintaining seal integrity under operational conditions. That is, each of the inner production stab body 11 and the outer annulus stab body 12 are essentially two separate pressure vessels that may experience different thermal loads (e.g., different temperatures) when in service. Such different thermal loads may cause the inner production stab body 11 and the outer annulus stab body 12 to exhibit different amounts of radial and/or axial expansion under certain operating conditions. In turn, such differences in radial and/or axial expansion between the inner production stab 11 and the outer annulus stab 12 can cause problems with respect to maintaining the integrity of the seals, e.g., the primary metal seal 19 and/or the secondary metal seal 17, on the prior art production/annulus stab 10. The novel one-piece production annulus stab 100 may help to eliminate or at least reduce this problem due to its one-piece construction.

Another problem with the prior art production/annulus stab 10 was related to the required radial thickness of the inner production stab body 11 and/or the outer annulus stab body 12. That is, each of the inner production stab body 11 and the outer annulus stab body 12 are essentially two separate pressure vessels that must be designed for the unique loading conditions experienced by each of these separate pressure vessels during operation. More specifically, since there were no lateral seals between the fluid flow paths 27, the exterior surface of the inner production stab body 11 was subjected to an external pressure which tended to compress the inner production stab body 11. The radial thickness of the inner production stab body 11 was increased to resist this external pressure. Additionally, due to the two-piece configuration of the prior art production/annulus bore stab 10, the outer annulus stab body 12 was subjected to an internal pressure (the annulus pressure) at its inner surface due to the presence of the fluid flow paths 27. Thus, the radial thickness of this outer annulus stab body 12 had to be sufficient to accommodate this additional pressure loading. In contrast, the novel one-piece production/annulus bore stab 100 disclosed herein is essentially a single pressure vessel. Of course, that single pressure vessel will also have to be designed and sized for all loading conditions, e.g., internal and external pressures. However, due to the unique one-piece configuration of the production/annulus bore stab 100 disclosed herein, as well as the placement of the individual fluid flow paths 103 within the body 102, the overall radial thickness of the body 102 will typically be less than the combined radial thicknesses of the inner production stab body 11 and the outer annulus stab body 12. Other advantages of the various embodiments of the one-piece production bore stab 100 disclosed herein may be apparent to those skilled in the art after a complete reading of the present application.

Figure 13:
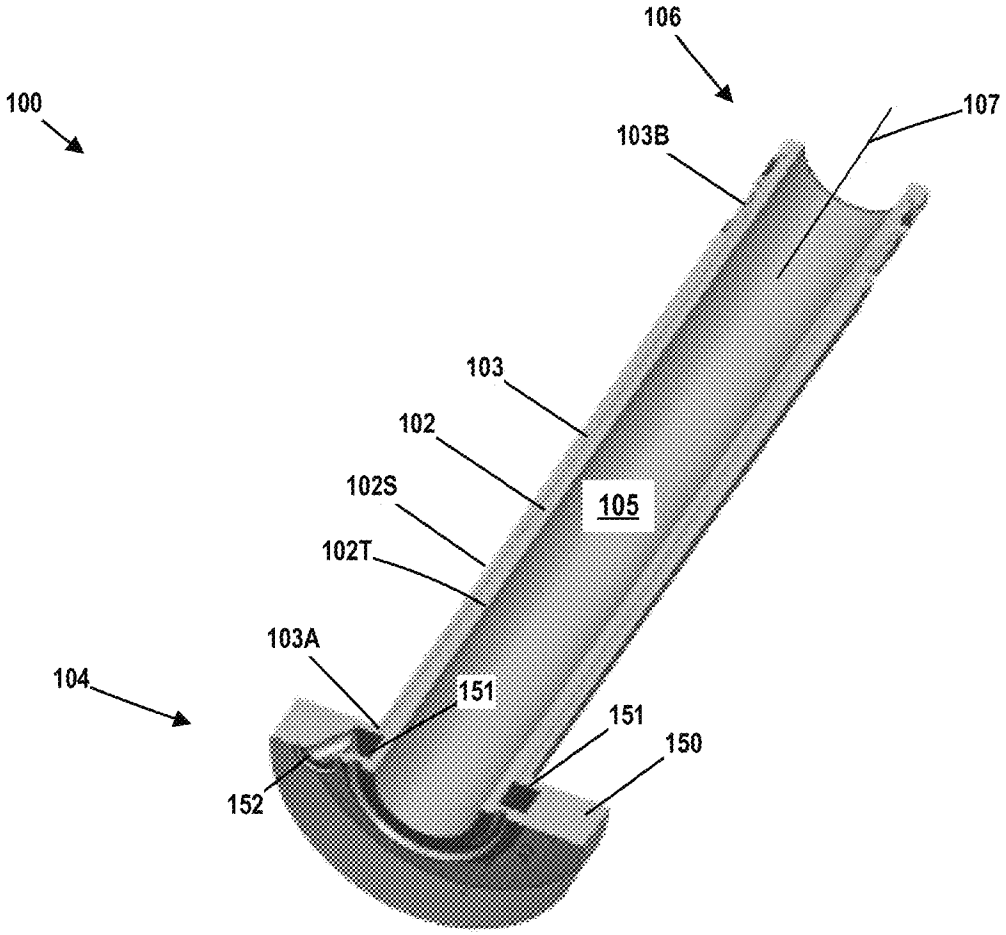
FIGS. 13-16 depict various aspects of yet another embodiment of a production/annulus bore stab with integral flow paths disclosed herein.
Figure 14:
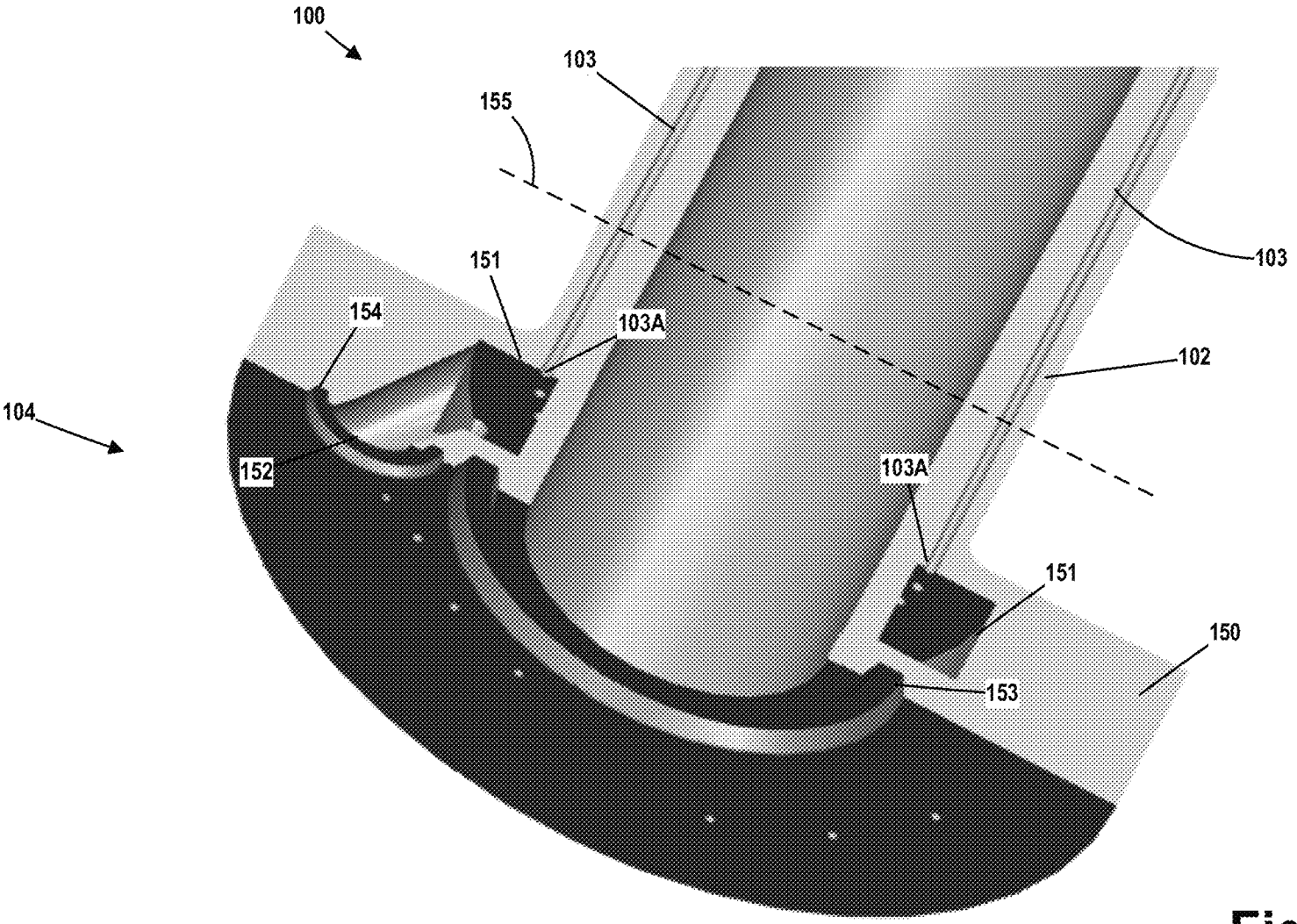
Figure 15:
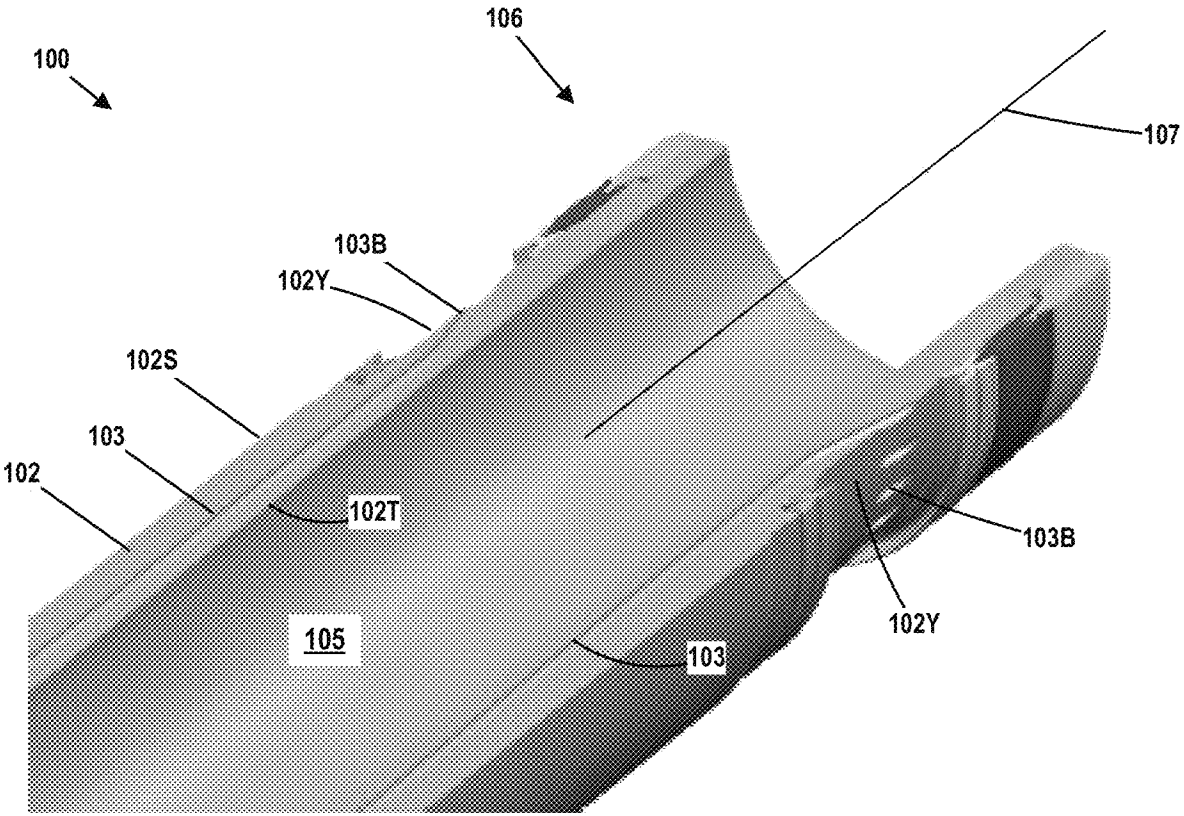

FIGS. 13-16 depict various aspects of yet another embodiment of a production/annulus bore stab with integral flow paths disclosed herein. FIG. 13 is perspective view of this illustrative example of a production/annulus bore stab 100 disclosed herein. FIG. 14 is an enlarged cross-sectional perspective view of the first end 104 of the production/annulus bore stab 100. FIG. 15 is an enlarged cross-sectional perspective view of the second end 106 of the production/annulus bore stab 100. Unless specifically noted otherwise, the above descriptions of various like-number components or features apply equally to this embodiment of the production/annulus bore stab 100.

Figure 16:
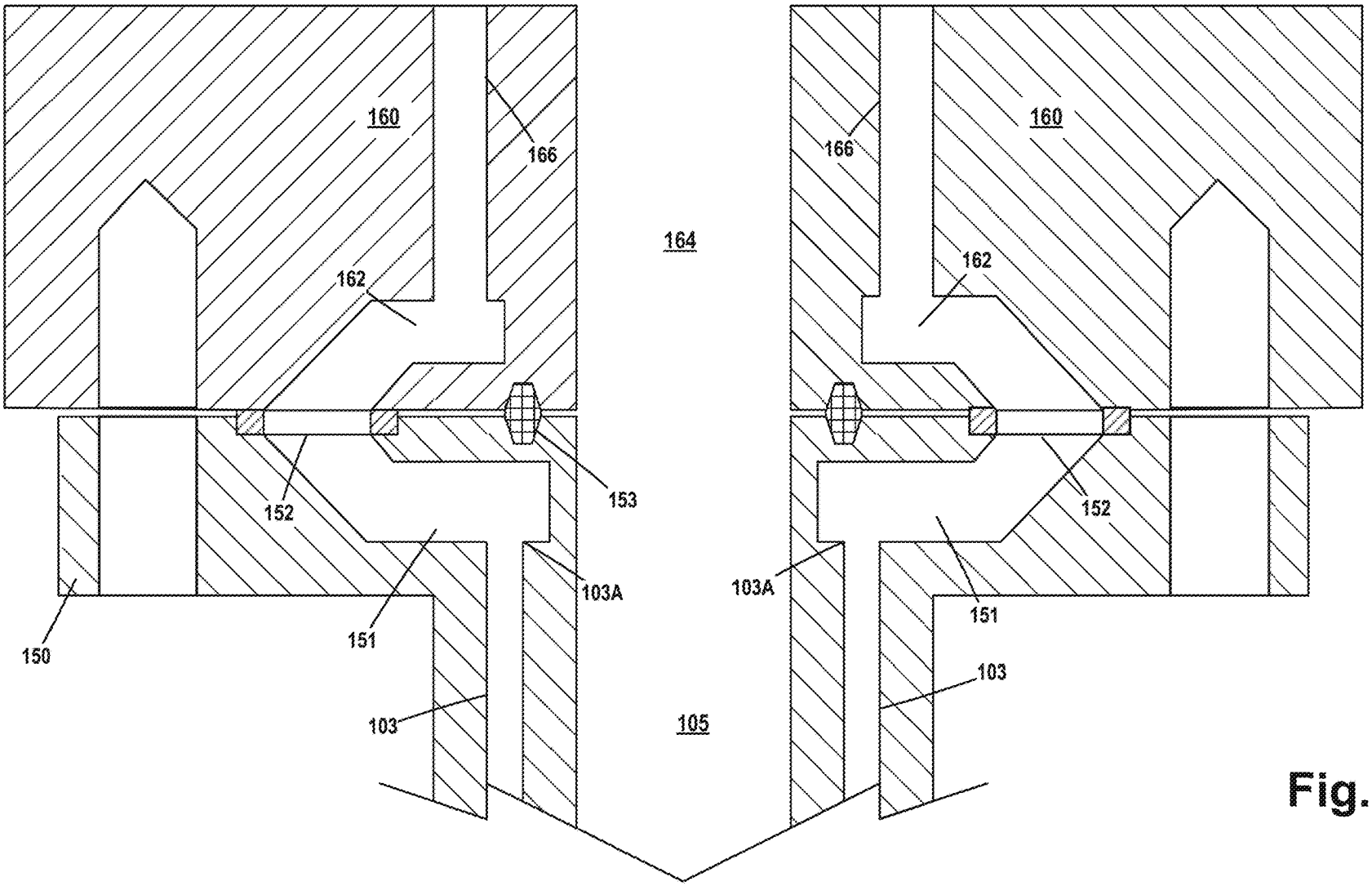

As before, in this embodiment, the individual and separate flow paths 103 are formed within the body 102. In this example, the production/annulus bore stab 100 comprises a flange 150 at the first (or upper end) 104. As shown in FIG. 16, the flange 150 is adapted to be coupled to another item of equipment 160, such as a valve block of a Christmas tree, etc. Also depicted is a radial gallery (or annulus fluid collection chamber) 151, an annulus fluid inlet/outlet 152, a production seal groove 153 and an annulus seal groove 154. Seals (not shown) will be positioned in the seal grooves 153, 154. Note that, in this example, the first inlet/outlet 103A of each of the individual flow paths 103 intersects the radial gallery 151, while the second inlet/outlet 103B of each of the flow paths 103 are positioned in or extend through the second cylindrical outer surface 102Y of the body 102. The item of equipment 160 also comprises a radial flow gallery 162 that is in fluid communication with the flow paths 103 in the body 102 and with one or more fluid flow paths 166 in the item of equipment 160. The internal bore 164 of the item of equipment is also depicted in FIG. 16. The flange 150 may be formed integral with the body 102 or it may be a separate component that that is welded to the remaining portion or the body at, for example, the location of the dashed-line 155 (see FIG. 14). For purposes of the attached claims, either of these configurations should be understood to constitute a one-piece body 102 for the production/annulus bore stab 100.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

The invention claimed is:

1. A production/annulus bore stab, comprising:

a unitary body comprising:

a first cylindrical outer surface, a second cylindrical outer surface, and an inner cylindrical surface that defines a central production bore; and a plurality of individual annulus fluid flow paths defined entirely within the unitary body, each of the individual annulus fluid flow paths being fluidly isolated from one another within the unitary body, each of the individual annulus fluid flow paths comprising a first inlet/outlet and a second inlet/outlet, wherein the first inlet/outlet is positioned in the first cylindrical outer surface and the second inlet/outlet is positioned in the second cylindrical outer surface, wherein each of the plurality of the individual annulus fluid flow paths are the same length between the first inlet/outlet and the second inlet/outlet;

wherein at least a portion of the unitary body is adapted to be positioned within and sealingly coupled to a production tree that has at least one annulus fluid flow path formed therein in communication with an annulus area directly between a production tubing and a production casing such that the at least one annulus fluid flow path within the production tree is in fluid communication with at least one of the plurality of individual annulus fluid flow paths defined within the unitary body via the first inlet/outlet or the second inlet/outlet.

2. The production/annulus bore stab of claim 1, wherein the unitary body has an axial length and wherein each of the plurality of individual annulus fluid flow paths extends for substantially the entire axial length of the unitary body.

3. The production/annulus bore stab of claim 1, wherein the unitary body has an axial length and a longitudinal centerline and wherein each of the plurality of individual annulus fluid flow paths comprises an axial length portion having a centerline that is substantially parallel to the longitudinal centerline.

4. The production/annulus bore stab of claim 3, wherein a centerline extending through a center of the first inlet/outlet and intersecting the flow path centerline at a first end of the axial length portion defines a first angle that is an obtuse angle.

5. The production/annulus bore stab of claim 1, wherein each of the plurality of individual annulus fluid flow paths is defined by a plurality of drilled bores in the unitary body.

6. The production/annulus bore stab of claim 1, wherein the unitary body comprises an axial length and a longitudinal centerline and wherein each of the plurality of individual annulus fluid flow paths is defined by:

an axial bore that extends for substantially the entire axial length of the unitary body, the axial bore comprising a centerline that is substantially parallel to the longitudinal centerline;

a first radially-oriented bore that intersects the axial bore, the first inlet/outlet being located adjacent a first end of the first radially-oriented bore; and a second radially-oriented bore that intersects the axial bore, the second inlet/outlet being located adjacent a first end of the second radially-oriented bore.

7. The production/annulus bore stab of claim 1, wherein each of the individual annulus fluid flow paths are the same length from a first end to a second end.

8. The production/annulus bore stab of claim 1, comprising a first seal adjacent a first end of the first cylindrical outer surface and a second seal adjacent a second end of the second cylindrical outer surface, wherein each of the first inlet/outlets are positioned between the first seal and the second seal.

9. The production/annulus bore stab of claim 1, wherein each of the first inlet/outlets are in fluid communication with one another outside of the unitary body adjacent the first cylindrical outer surface when the production/annulus bore stab is positioned within and sealingly coupled to the production tree.

10. The production/annulus bore stab of claim 1, wherein the plurality of individual annulus fluid flow paths are in fluid communication with a radial gallery when the production/annulus bore stab is positioned within and sealingly coupled to the production tree.

11. The production/annulus bore stab of claim 10, wherein the radial gallery is in fluid communication with all annulus fluid flow paths within the unitary body.

12. The production/annulus bore stab of claim 10, comprising a seal spacer having one or more openings that allow fluid to flow freely between the plurality of individual annulus fluid flow paths and the production tree.

13. The production/annulus bore stab of claim 10, wherein the radial gallery is defined at least in part by the production tree when the production/annulus bore stab is positioned within and sealingly coupled to the production tree.

14. The production/annulus bore stab of claim 11, wherein the production/annulus bore stab comprises a flange adapted to couple with the production tree.

15. The production/annulus bore stab of claim 11, wherein the radial gallery is defined by an outer diameter of the unitary body and an inner diameter of the production tree.

16. The production/annulus bore stab of claim 1, wherein the plurality of flow paths are evenly spaced from one another around the unitary body.

17. The production/annulus bore stab of claim 1, wherein each of the plurality of individual annulus fluid flow paths is defined by respective drilled bores in the unitary body.

18. A system, comprising:

an item of equipment comprising:

at least one annulus fluid flow path formed therein, the annulus fluid flow path configured to be in fluid communication with an annulus area directly between a production casing and a production tubing that defines a path for conveying production fluids from a well formation to a wellhead; and a production/annulus bore stab comprising:

a unitary body comprising a first cylindrical outer surface, a second cylindrical outer surface, and an inner cylindrical surface that defines a central production bore, wherein at least a portion of the unitary body is positioned within and sealingly coupled to the item of equipment; and a plurality of individual annulus fluid flow paths defined entirely within the unitary body, each of the individual annulus fluid flow paths being fluidly isolated from one another within the unitary body, each of the individual annulus fluid flow paths comprising a first inlet/outlet and a second inlet/outlet, wherein the first inlet/outlet is positioned in the first cylindrical outer surface and the second inlet/outlet is positioned in the second cylindrical outer surface, wherein each of the plurality of the individual annulus fluid flow paths are the same length between the first inlet/outlet and the second inlet/outlet;

wherein the at least one annulus fluid flow path within the item of equipment is in fluid communication with at least one of the plurality of individual annulus fluid flow paths defined within the unitary body via the first inlet/outlet or the second inlet/outlet.

19. The system of claim 18, wherein the plurality of individual annulus fluid flow paths are in fluid communication with an annulus fluid collection chamber.

20. The system of claim 19, wherein the annulus fluid collection chamber is defined at least partially between the first cylindrical outer surface and the item of equipment.

21. The system of claim 20, wherein the item of equipment is a production tree.

22. The system of claim 21, wherein the production tree comprises a valve block that defines a production fluid flow path, an annulus fluid flow path, and an annulus fluid collection chamber.

23. The system of claim 18, wherein the item of equipment is a tubing hanger.

24. The system of claim 18, wherein each of the individual annulus fluid flow paths are the same length from the first end to the second end.

25. The system of claim 18, wherein the production/annulus bore stab comprises a flange coupled with the item of equipment.

26. The system of claim 18, wherein the unitary body has an axial length and a longitudinal centerline and wherein each of the plurality of individual annulus fluid flow paths comprises an axial length portion having a centerline that is substantially parallel to the longitudinal centerline, and wherein each of the plurality of individual annulus fluid flow paths comprises a first flow path transition region between the axial length portion and the first inlet/outlet and a second flow path transition region between the axial length portion and the second inlet/outlet.

27. The system of claim 26, wherein each of the plurality of individual annulus fluid flow paths comprises first and second radially-oriented flow paths that are in fluid communication with the axial length portion, the first radially-oriented flow path terminating at the first inlet/outlet, the second radially-oriented flow path terminating at the second inlet/outlet, wherein a centerline of each of the first and second radially-oriented flow paths is positioned substantially normal to the flow path centerline.

28. The system of claim 18, comprising a seal spacer having one or more openings that allow fluid to flow freely between the plurality of individual annulus fluid flow paths and the item of equipment.

29. The system of claim 18, wherein each of the plurality of individual annulus fluid flow paths is defined by respective drilled bores in the unitary body.

30. The system of claim 29, wherein the production/annulus bore stab includes flow path plugs sealingly located with the drilled bores proximate at least a first end of the unitary body.

* * * * *